US005972135A

United States Patent [19]

Pugh

[11] Patent Number: 5,972,135

[45] Date of Patent: Oct. 26, 1999

[54] STRESS RELIEVED GRINDING ROD HAVING HARD OUTER SHELL

[75] Inventor: Robert William Pugh, Sherwood Park, Canada

[73] Assignee: Stelco Inc., Ontario, Canada

[21] Appl. No.: 09/089,338

[22] Filed: Jun. 3, 1998

[51] Int. Cl.[6] ..... C21D 9/08

[52] U.S. Cl. ..... 148/595; 148/575; 148/902

[58] Field of Search ..... 148/575, 595, 148/334, 333, 902

[56] References Cited

U.S. PATENT DOCUMENTS 4,589,934 5/1986 Glodwski et al. .

4,840,686 6/1989 Arnett et al. .

*Primary Examiner*—Deborah Yee

*Attorney, Agent, or Firm*—Alston & Bird LLP

[57] ABSTRACT

A grinding rod having a hardened outer shell of tempered martensite is adapted for use in heavy duty grinding environments. The rod is stress relieved to reduce internal compressive stresses in the tempered martensitic shell to less than 60 ksi and greater than 15 ksi. Such stress relieve stabilizes the rod against break-up as caused by the balancing tensile stresses in the pearlitic core exceeding tensile strength of the core.

14 Claims, 2 Drawing Sheets

FIG. 3.
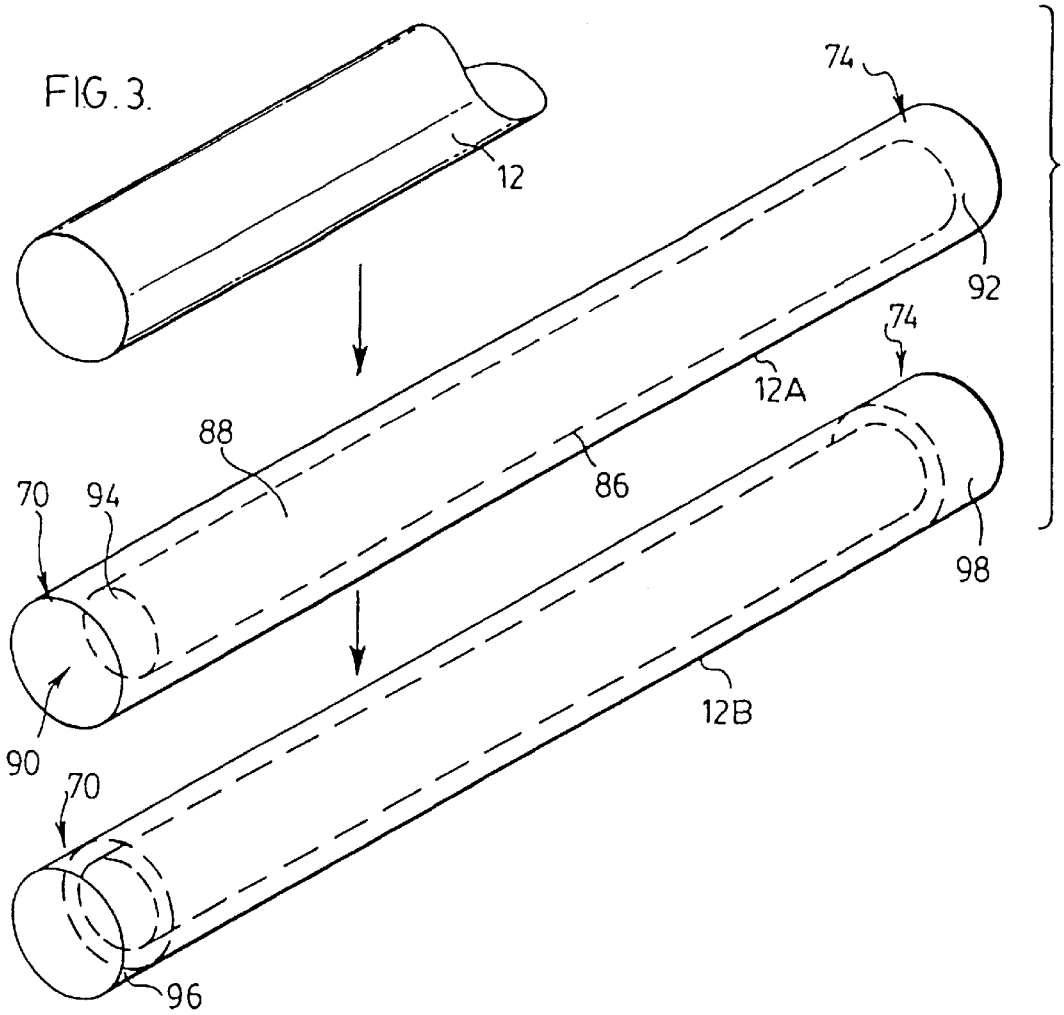
FIG. 2.
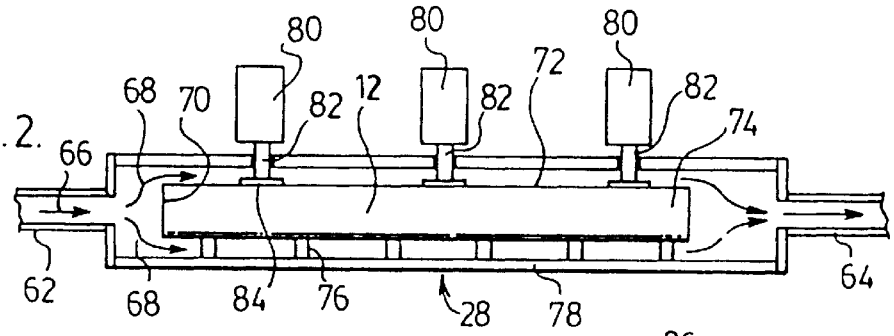
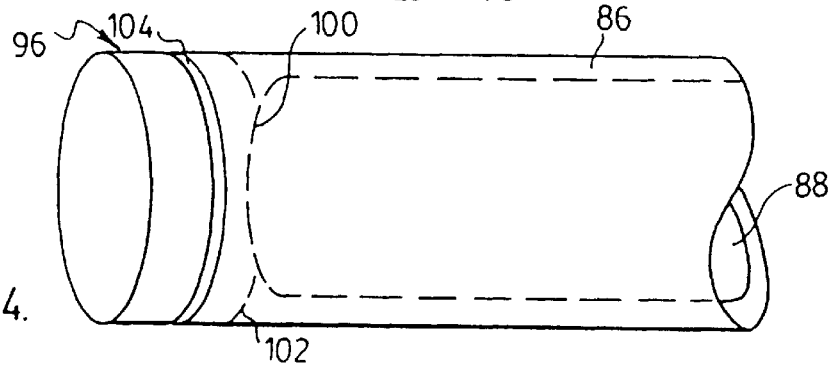
FIG. 4.

STRESS RELIEVED GRINDING ROD HAVING HARD OUTER SHELL

FIELD OF THE INVENTION

This invention relates to stress relieved grinding rods to enhance durability of the rods, particularly in heavy duty grinding environments.

BACKGROUND OF THE INVENTION

Various technologies are available for manufacturing grinding rods for use in grinding mills, such as in ore crushing, stone crushing and the like. Grinding rods are usually 3 to 6 meters in length depending upon the size of the grinding device and have diameters which usually range from 7 to 10 cm. It has been found that the useful life of a grinding rod may be improved if it has a hard outer shell usually of martensitic microstructure and relatively soft end portions which are substantially of pearlitic microstructure. The soft end portions minimize rod spalling and splitting thereof and reduce breakage and wear of the rod mill liners. A discussion of grinding rods having soft end portions may be found in U.S. Pat. No. 4,589,934 as well as the several other U.S. patents discussed in the background of that U.S. patent.

In an attempt to improve grinding rod longevity by way of heat treatment, the chemistry of the steel in the grinding rod may be modified such as described in U.S. Pat. No. 4,840,686. The modification of the chemistry in the steel of the grinding rod results in the rod core having a bainitic microstructure with less than 10% pearlite and a core hardness of at least about 40 Rockwell C, or 40 HRC. It is thought that making rods with the proper selection of molybdenum and chromium to provide a rod core of mostly bainite enhances the wear rate resistance of the rod by nearly 20% over that of a conventional heat treated rod. The selected chemistry and heat treatment ensures that the core is of the harder bainite where softer pearlitic material is to be avoided.

The rods, as made in accordance with either of U.S. Pat. Nos. 4,589,934 and 4,840,686 are quenched after heating by passing the rod through a quench spray. The quenching of the rod is commenced inwardly of the leading end of the rod and the quench spray turned off short of the trailing end of the rod. It is thought that by not applying quench water spray to the leading end and trailing end of the rod, softer end portions are developed. Also as taught, the rod may have to pass through multiple quench zones in order to achieve the desired extent of quenching to ensure the formation of the harder martensitic shell. As is described in U.S. Pat. No. 4,589,934, minor amounts of quench water travelling along the rod surface towards either the leading or trailing end portion may create a wash effect, thereby expediting cooling of the end portion resulting in the formation of end portions which can have a hardness greater than 30 and perhaps up to 45 or 50 HRC. To minimize this effect, the commencing of the quench water spray and terminating of the quench water spray are activated or deactivated a considerable distance from each end. A significant portion of the rod end is not treated resulting in a fairly large transition zone between the quench portion of the rod which has the martensitic structure and the untreated end portion of the rod which has the pearlitic structure. In practice, the softer end portions of the rod may extend upwards of 30 cm or more with a very gradual transition from the hard shell to the softer portion. This results in a grinding rod having a greater length of softer end portion with consequent increased wear.

A further problem with the grinding rod of U.S. Pat. No. 4,840,686 is that it was found in heavy duty grinding environments that the rods quickly broke up due to the abuse during grinding, even though it was thought that the harder bainitic core would resist such break up. It is a natural assumption that, in order to increase wearability of the rods in heavy duty grinding environments, the rods would naturally have a harder outer martensitic shell. However, neither grinding rods with bainitic cores or much softer pearlitic cores perform very well in heavy duty grinding environments. Such rods with the harder outer martensitic shells tend to break up too quickly thereby rendering them useless in the grinding environment. It is understood, of course, that such rods with the harder outer shells, particularly with pearlitic cores, function very well in light duty and medium duty grinding environments. There are no exacting criteria as to what constitutes light duty, medium duty and heavy duty grinding environments. Consideration is however given to the critical speed of the mill where it is understood that increasing critical speed increases the duty of the grinding environment. Other factors include the diameter of the mill, the diameter of the rods in the mill and the length of the rods where it is understood that the longer rods tend to break up more readily than the shorter rods. With these criteria in mind, one skilled in the art can predict the duty of the grinding environment and hence select rods appropriate to that end use.

Accordingly, this invention provides grinding rods which have the desired wearability and have the desired durability in heavy duty grinding environments. This advantage of this invention has been surprisingly provided by way of a stress relieving technique for tempered grinding rods, particularly those having deeper and harder martensitic shells of a hardness greater than 50 and usually 55 to 65 Rockwell C. Although stress relieving techniques have been used in conjunction with tool steels, this is generally understood by those skilled in the art to perform different functions in view of the high alloy contents and high carbon contents of tool steels. The purpose of stress relieving is to modify the structure of the tool steel so that stress relieving of tool steels is conducted at relatively high temperatures usually around 500° C. In view of the high alloy content, it is generally understood that stress relieving at these high temperatures brings about a change in the characteristic of the tool steel. Conversely, it is generally understood that tempering of mild steel products after the first temper does not bring about any significant changes in the physical characteristics of the product.

SUMMARY OF THE INVENTION

In accordance with an aspect of the invention, a grinding rod has a hardened outer shell of tempered martensite wherein said rod has been stress relieved to reduce longitudinal internal compressive stresses in the tempered martensitic shell to less than 60 ksi and greater than 15 ksi and thereby stabilize said rod against break up as caused by the balancing tensile stresses in the pearlitic core exceeding the tensile strength of the core.

In accordance with another aspect of the invention, the grinding rod has a chemistry of:

| | |
|---|---|
| carbon | .70–1.00% by weight |
| manganese | .60–1.00% by weight |
| silicon | .10–.40% by weight |
| chromium | residual levels–1.04% by weight |
| molybdenum | residual levels–0.5% by weight. |

In accordance with another aspect of the invention, a grinding rod with a bainitic core has a chemistry of:

| | |
|---|---|
| carbon | at least 0.7% by weight |
| manganese | less than 0.7% by weight |
| silicon | .10–.40% by weight |
| chromium | at least .25% by weight |
| molybdenum | at least .25% by weight. |

In accordance with a preferred aspect of the invention, a rod with a pearlitic core has a chemistry of:

| | |
|---|---|
| carbon | .70–1.00% by weight |
| manganese | .60–1.00% by weight |
| silicon | .10–.40% by weight |
| chromium | .25–1.04% by weight |
| molybdenum | .01–.25% by weight |

balance being essentially iron with the proviso that a combination of carbon, molybdenum and chromium with the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon with a minimum of 0.01% molybdenum, chromium is equal to or less than 0.80% and with a maximum of 0.25% molybdenum, chromium is equal to or less than 0.28%.

In accordance with another aspect of the invention, a process is provided for making the stress relieved grinding rods where the process comprises:

i) reheating a tempered grinding rod having a hardened outer shell of tempered martensite to its previous equalization temperature of its earlier tempering process;

ii) holding the grinding rod at the equalization temperature for a period of time sufficient to relieve compressive stresses in the tempered martensite shell to less than 60 ksi and greater than 15 ksi; and iii) allowing the reheated stress relieved bar to cool.

BRIEF DESCRIPTION OF THE DRAWINGS

Aspects of the manufacture of tempered grinding rods and their stress relieve are described with respect to the drawings wherein:

FIG. 2 is a schematic cross-section through a representative type of bar quenching device, such as described in U.S. Pat. No. 4,376,528, the subject matter of which is incorporated herein by reference;

FIG. 3 illustrates the steps in heat treating the bar; and

FIG. 4 is an enlarged view of an end portion of the grinding rod.

DETAILED DESCRIPTION OF THE PREFERRED EMBODIMENTS

Figure 1:
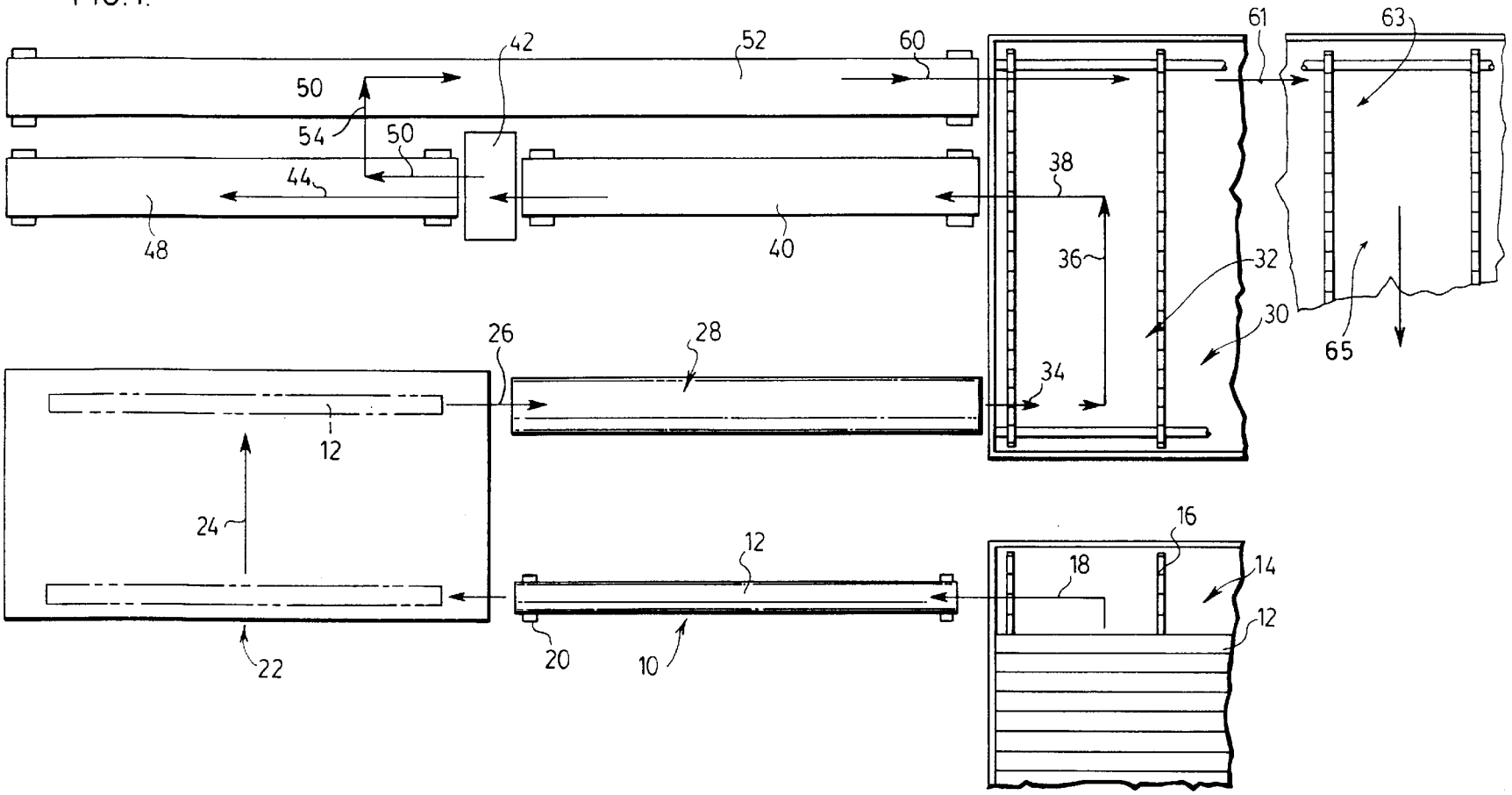
FIG. 1 is a schematic of a heat treating line for heat treating and self-tempering steel bar to form grinding rods with soft ends followed by stress relieve.

Applicant has found that the durability of the long wearing, hard outer shell grinding rods can be surprisingly enhanced by carrying out a mild stress relieve on the tempered rod. This advance in grinding rod technology is particularly important in supplying rods with enhanced performance, particularly in heavy duty grinding environments. The stress relieve of the tempered rod applies to a broad range of chemistries for the bar stock as well as the types of crystalline structure for the rod core and rod shell. Preferably, the grinding rods, as stress relieved by this invention, continue to have the softened end portions particularly of the type as described in applicant's co-pending U.S. patent application Ser. No. 09/042,484 filed Mar. 16, 1998. For example, grinding rods having a martensitic hard outer shell usually in excess of 50 and preferably from 55 to 65 Rockwell C with a substantially pearlitic core become very durable when stress relieved. Correspondingly, grinding rods with a similar hard martensitic outer shell and a bainitic core have enhanced durability properties when stress relieved in accordance with this invention. Although it is not fully understood why the stress relieving brings about this unexpected enhancement in durability, it is thought that the stress relieve step somehow reduces the stresses in the shell and core in a manner which considerably increases resistance to break up. Usually, stress relieving of steel reduces the hardness characteristic. This, of course, would not be a benefit when designing grinding rods to have harder outer shells. It has been found, however, that tempered grinding rods, when stress relieved at or about their equalization temperature, for a period of time sufficient to reduce compressive stresses in the outer shell do not at the same time have any appreciable effect on the shell hardness. The period of time for reheating and holding the tempered grinding rod at the equalization temperature is sufficient to reduce the compressive stresses in the outer shell to less than 60 ksi and preferably greater than 15 ksi. Such mild form of stress relieve stabilizes the rod against break up as caused by the balancing longitudinal tensile stresses in the pearlitic core exceeding the tensile strength of the core. Although it was generally understood that reheating tempered steel to its equalization temperature would not have any effect on the stresses in the steel item, it has been surprisingly found that such reheat for the very long bar stock of the grinding rod does relieve stresses in the outer shell without appreciably reducing hardness in the outer shell. The equalization temperature is the temperature to which the rod reheats to after quench in its first heat treatment where the temperature is essentially uniform across the section of the bar after the bar has equalized in temperature.

Now that it has been realized that a form of stress relieve for the bar appreciably increases durability of the bar, a superior product is provided for heavy duty grinding environments. It is thought that bars with very hard outer shells inherently had very high compressive stresses in the outer shell which result in very high core tension. It is thought that reducing the compressive forces in the outer shell correspondingly reduced tension on the core. Such reduction in stresses stabilized the rod against break up as would normally be caused by high compressive stresses exceeding the tensile strength of the core. Depending upon the type of chemistry and the type of heat treating of the bar to produce a grinding rod, the equalization temperature for the stress relieve process will vary, but only to the extent that one skilled in the art, based on the following examples of chemistry and stress relieve times, can readily determine.

In accordance with preferred aspects of the invention, the harder outer martensitic shell can be provided by selecting the amount of carbon used in the steel alloy to be in the range of 0.7 to 1.0% by weight. This range of carbon can achieve an outer shell hardness greater than 50 Rockwell C and up to 65 Rockwell C depending upon the manner of heat treatment. Manganese is included at a level in the range of about 0.6 to 1.0% by weight and silicon is included at a level of about 0.1 to 0.4% by weight. In order to achieve an annular uniform layer of martensite of substantial depth, significant amounts of chromium and/or molybdenum are used. The amount of chromium ranges from residual levels up to 1.04% by weight. Molybdenum in the rod ranges from residual levels up to 0.5% by weight.

The above broad ranges for the chemistry of the bar stock provides a host of combinations which achieve desired ranges in the hardness of the outer martensitic shell and hardness of the rod core. Such variation in the rod characteristics provide for a variety of applications including light, medium and heavy duty applications. The advantage of the second tempering of the rod allows one to achieve uses for the rods in heavier duty applications while implementing a less expensive chemistry.

In accordance with an aspect of the invention, a preferred chemistry for the rod is as follows:

| | |
|---|---|
| carbon | .70–1.00% by weight |
| manganese | .60–1.00% by weight |
| silicon | .10–.40% by weight |
| chromium | .25–1.04% by weight |
| molybdenum | .01–.25% by weight |

the balance being essentially iron and with the proviso that a combination of carbon, molybdenum and chromium with the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon with a minimum of 0.01% molybdenum, chromium is equal to or less than 0.80% and with a maximum of 0.25% molybdenum, chromium is equal to or less than 0.28%. This preferred chemistry also lends the rod heat treatment to provide grinding rods having the desirable soft ends of hardness less than 35 Rockwell C and the soft rod core of greater than 99% pearlitic and a hardness less than 45 Rockwell C. At the same time such chemistry provides an outer martensitic shell having a hardness greater than 55 Rockwell C and up to 65 Rockwell C and greater. By virtue of the selected chemistry and a preferred type of heat treatment, the martensitic shell is of a uniform annular thickness preferably greater than about 1.25 cm and up to 1.60 cm or more in depth. The preferred method of heat treating with this chemistry is capable of providing soft end portions of a length of about 10 cm to 15 cm and having a hardness less than 35 Rockwell C.

The engineered heat treating of the end portions can be modified to provide intermediate portions of a hardness less than 25 Rockwell C to thereby provide a ring with improved crack arresting properties. It has been found that with the preferred method of heat treating, a grinding rod is produced which is relatively straight by virtue of the process and chemistry of this invention providing uniform stresses in the outer annular shell of tempered martensite.

It is also understood that other chemistries may be selected and depending upon the tempering process, different characteristics are provided for the core of the grinding rod. For example, the chemistry suggested in U.S. Pat. No. 4,840,686 may be selected with a heat treating process which produces a bainitic core with substantially no pearlite. As taught in that patent, the subject matter of which is hereby incorporated by reference, the chemistry may be in the range of carbon at least 0.7% by weight; manganese less than 0.7% by weight; chromium at least 0.25% by weight and molybdenum at least 0.25% by weight. Such chemistry usually results in a bainitic core after the first tempering.

The preferred process for tempering the bar to produce grinding rod comprises quenching the rod in an elongate vessel which delivers high velocity quench water along the length of the bar to rapidly cool the bar with minimal generation of steam on the bar surface. Such rapid controlled quench along the length of the bar develops a uniform layer of martensite having the higher hardness in the range of about 55 to 65 Rockwell C while developing uniform balanced stresses around and along the martensite shell to provide the desirable rod straightness. After the rapid controlled quench, the bar is withdrawn from the quench vessel. In this regard, a representative heat treating line 10 for reheating steel bar, quenching a steel bar and subsequently heat treating each bar end portion is shown in FIG. 1. Individual bars 12 are advanced on a rack 14 which may include a chain/dog advancing mechanism 16. Each individual bar 12 is advanced off the rack 14 in the direction of line 18. The bar may be passed on suitable rollers 20 into a reheat furnace 22 which is temperature controlled to ensure that the individual bars 12, as they advance in the direction of arrow 24 across the furnace, are reheated to the preferred austenitising temperature. Each bar, at the desired reheat temperature, is transferred out of the furnace 22 in the direction of arrow 26 into a quenching vessel 28 which is described in more detail with respect to FIG. 2. The quenching vessel 28 delivers the high velocity quench water to develop an annular layer of martensite of uniform depth when the bar is allowed to exit the quench vessel at a temperature, such that soak back temperature which is the equalization temperature is less than 350° C. and greater than 150° C. The quenched bar is transferred to rack 30 with advancing chain/dog system 32. The bar, as advanced in the direction of arrow 36 after having been removed from the quench vessel 28 in the direction in the arrow 34, is advanced in the direction of arrow 38 onto a bar conveyor system 40. The leading end of the bar is inserted into a furnace 42 which may be an annular induction furnace to reheat a specified portion of the bar end which is preferably less than 15 cm in length. The end portion is heated to its austenitising temperature and then passed through the annular induction furnace 42 in the direction of arrow 44, so that the end portion may be air cooled and thereby provide an engineered end portion hardness of less than 35 Rockwell C. After the bar end is removed from the furnace in the direction of arrow 44 and transferred to conveyor 48, the other end of the bar is then positioned in the furnace 42. The other bar end is now reheated in the furnace 42 to its austenitising temperature and withdrawn in the direction of arrow 50 to permit air cooling thereof. The bar is transferred to conveyor 52 in the direction of arrow 54. The bar with both ends softened is transferred from the conveyor 52 in the direction of arrow 60 onto the rack 30 for transport to a cooling and bundling station 63 in the direction of arrow 61 where the bars are inspected, optionally bundled, identified and color coded as required.

It is understood, of course, that when producing bars of bainitic cores where a controlled engineered soft end portion is not required, the intermittent water spray technique of U.S. Pat. No. 4,589,934 may be employed, the subject matter of which is hereby incorporated by reference.

The process of FIG. 1 may include a stress relieve station after the cooling station. Alternatively, the stress relief may be carried out at another location, off-line from this processing line. After the individual bars which may be in separate or bundled form are cooled down at station 63, they may be transferred in the direction of arrow 65 to a stress relieving station. Preferably, the individual or bundled tempered rods are stress relieved within a day or two of the tempering process. This may require substantial accumulators in the racking system 63. It is understood that as the rods cool down the compressive stresses in the outer tempered martensitic shell should not exceed the balancing tensile strength of the core. If there is a problem with the rods breaking up, then it is understood that the rods are stress relieved shortly after the bars have cooled which would be within about 12 hours of the end treatment process.

At the stress relieve station, the individual rods or bundles are reheated to the equalization temperature of the first or earlier tempering process. In accordance with this particular embodiment for the hardened bar, the equalization temperature is less than 350° C. and greater than 150° C. which is the same as the soak back temperature of the rods when they exit the quench vessel. The individual rods or bundles are held at the equalization temperature for a limited period of time sufficient to reduce internal longitudinal compressive stresses in the hard martensitic shell. It has been found that maximum durability of the rods is obtained when the longitudinal compressive stresses in the martensitic shell are less than 60 ksi and greater than 15 ksi. This limited period of treatment in reducing the compressive stresses in the martensitic shell does not, at the same time, appreciably affect the hardness of the outer shell. There may be a slight drop, but only in the range of 1 or 2 points of Rockwell hardness. It is also understood that in circumstances where rods with a lower degree of hardness are required, but yet of significant durability, the stress relieve process may also be useful. For example, with grinding rods having martensitic shells of a hardness in the range of 45 to 55 Rockwell C, the stress relieve process may be used if warranted to enhance further the toughness and durability of the rod by reducing the compressive stresses in the martensitic shell.

As shown in FIG. 2, the quench vessel 28 may be of the type, for example, as described in U.S. Pat. Nos 4,376,528 or 3,997,375. Although both of these patents describe quenching systems for quenching tubular pipe where water flows along the inside and the outside of the pipe, the same system may be used to heat treat solid bar, where significant unexpected advantages flow from use of the tubular pipe quench system in forming the harder grinding rods. With reference to FIG. 2, a schematical cross-section of the quench vessel 28 includes a water inlet 62 and a water outlet 64. Water is forced through the inlet in the direction of arrow 66 where it flows outwardly in the direction of arrow 68 over the end portion 70 of the bar 12. The water then flows along the surface 72 of the bar and over the downstream end 74 where the water converges and flows out through the outlet 64. The bar 12 may be supported on suitable supports 76 which may be spaced apart along the bottom wall 78 of the vessel, or may be one continuous support along the bottom wall. In any event, the supports 76 make point contact with the bar 12 to maximize the surface area 72 exposed to the water flowing longitudinally over the bar 12. Preferably, the quench vessel 28 includes hydraulic pistons 80 which have water sealed rams 82 extending through the vessel. The rams include plates 84 which contact the surface 72 and thereby clamp the bar within the vessel to further resist bar warping during the quenching process. As taught in U.S. Pat. No. 4,376,528, the velocity of the quench water is maintained at or above a minimum operating level to ensure that steam does not develop at the bar surface and thereby affect the rate of heat transfer from the bar to the quenching water. Cooling water preferably travels at a minimum surface velocity relative to the bar of about 4 meters per second and may flow at surface velocities much greater, for example, up to 15 meters per second. The ideal flow velocity is usually in the range of about 5 meters to 8 meters per second. At these velocities, a uniform outer shell of martensite is produced where the bar is quenched in the vessel for a period of time which provides a bar surface equalization temperature, when removed from the vessel 28, of less than 350° C. and greater than 150° C. We have determined that quenching the bar in a vessel of the type shown in FIG. 2 ensures that any vapor produced at the bar surface is instantly flushed away to provide a uniform and rapid quenching of the bar surface. This type of quenching ensures the development of a uniform outer shell of martensite. By virtue of this quenching process as well as the clamping of the bar in the vessel, we have unexpectedly found that the bar, after cooling, maintains rod straightness. Such rod straightness has been found preferably to be less than 1.25 cm deviation from a straight line along entire rod length. It is thought that the uniform quenching of the bar surface develops a uniform compressive force in the martensite shell to maintain rod straightness.

Within the range of the above surface velocities, the length of time that the bar is quenched in the vessel is for a defined period. Preferably, the quench water temperatures range from 10° C. to 40° C. at vessel inlet, although it is appreciated that other quench water temperatures may be selected as long as the quenching achieves the desired rate of quench to provide the desired martensite layer. For quench water temperatures in the range of 30° C. to 35° C., quench times range from 110 seconds to 160 seconds for rods having diameters ranging from about 7.5 cm to about 10.1 cm. With this period of quenching and the selected chemistry, it has been found that the tempered martensite shell has a radial depth of at least about 1.25 cm and usually about 1.6 cm or greater.

As shown in FIG. 3, the bar 12 is reheated to its austenitising temperature. As is appreciated by those skilled in the art, the austenitizing temperature will depend on the chemistry of the material selected from the following ranges,

| | |
|---|---|
| carbon | .70–1.00% by weight |
| manganese | .60–1.00% by weight |
| silicon | .10–.40% by weight |
| chromium | .25–1.04% by weight |
| molybdenum | .01–.25% by weight |

The selection from the above ranges requires a degree of guidance as offered by the proviso that a combination of carbon, molybdenum and chromium within the above ranges are selected as follows to provide a non-bainitic core:

a) at the lower 0.7% carbon with a minimum of 0.01% molybdenum, chromium is equal to or less than 1.04% and with a maximum of 0.25% molybdenum, chromium is equal to or less than 0.43%; and b) at the upper 1.00% carbon, with a minimum of 0.01% molybdenum, chromium is equl to or less than 0.80% and with a maximum of 0.25% molybdenum, chromium is equal to or less than 0.28%.

In accordance with this proviso in the chemistry selection, it is apparent that, as the carbon content rises, with lower amounts of molybdenum the amount of chromium is higher and with higher amounts of molybdenum, the amount of chromium is relatively lower. Hence, for a 0.7% carbon chemistry, the molybdenum and chromium may range from 0.1% to 1.04% ; chromium to 0.25% molybdenum and 0.43% chromium; and for a 1.0% carbon chemistry, the molybdenum and chromium may range from 0.01% molybdenum and 0.80% chromium to 25% molybdenum and 0.28% chromium. With these ranges, one skilled in the art can readily interpolate the concentrations of molybdenum and chromium for carbon contents between 0.7 and 1.00%.

With this chemistry, the preferred austenitising temperature is in the range of about 775° C. to about 870° C. When the bar is quenched in vessel 28, a uniform layer 86 of martensite is formed along the entire length of the quenched bar 12A. The selected chemistry ensures the formation of the deep layer of martensite. The core portion 88, on the other hand, during the heat treatment develops a pearlitic structure in the range of at least about 99% pearlite. The ends 70 and 74 of the bar have hardened portions 90 and 92 inwardly of the end, as depicted by the termination of the core portion at transition line 94. The bar ends 70 and 74 are then reheated in a suitable furnace which is preferably an induction coil. A selected length of each end portion is reheated, preferably less than 15 cm where the end portions 96 and 98 are reheated to their austenitising temperature without appreciably heating the rest of the bar. The end portions are then, as described with respect to FIG. 1, air cooled to provide end portions which are of substantially pearlitic microstructure and have a hardness of less than 35 Rockwell C. With appropriate control of the end heating, the end portions may have a hardness of less than 30 Rockwell C.

In order to minimize the effects that hydrogen has on the rolled bar stock, it is understood that the bar may be subjected to a degassing step. This step minimizes hydrogen build-up in the bar to enhance crack resistance of the bar during heat treatment and in the rod during use.

As shown in FIG. 4, the soft end portion 96 extends from beyond the transition zone 100, which defines the end of the pearlitic core 88, and the end of the martensitic shell 86 as defined by dotted line 102. The softer end 96, which as already noted, may have a hardness considerably less than 35 Rockwell C may be treated in a manner to include an intermediate annular ring 104 which may have a hardness less than 25 Rockwell C to provide thereby a softer end with improved crack arresting properties. This small annular ring of softer material assists the end portion 96 in arresting any cracks which attempt to propagate along the rod.

With the preferred chemistries and preferred tempering process, it has been found that equalization temperatures are normally in the range of about 150° C. to about 350° C. where for chemistries which produce a hardness of 60 to 65, the preferred equalization temperature is about 200° C. The tempered rod is heated and after it uniformly attains the equalization temperature, it is held at the equalization temperature for only about 30 minutes. During this period of time, the compressive stresses in the martensitic shell are considerably reduced preferably down to within the range of about 20 to 40 ksi. After this predetermined period of reheat for purposes of stress relieve, the individual rods or bundles of rods are air cooled.

It is appreciated that various processing parameters may change depending upon the size of the bar stock, the chemistry of the bar, the structure of the quenched vessel, the supports in the quenched vessel and the clamps for the bar in the quench vessel.

It is appreciated that these modifications are well within the purview of those skilled in the art to achieve all of the benefits and advantages of this invention which in summary are as follows. The technique of this invention for mildly stress relieving the compressive stresses in the martensitic shell provide grinding rods with superior durability particularly when used in heavy duty grinding environments. Additional benefits for the rod include the engineered soft end portions which ensure that the end is well defined and is considerably shorter than what can be produced by prior art processes. The quenching of the bar with high velocity water quenched stream ensures a uniform quenching of the bar surface and hence the development of uniform compressive stresses in the outer shell of martensite. This indeed contributes to rod straightness, but as well during the stress relieving process ensures that rod straightness is maintained due to the uniform mild relieve of stresses in the martensitic shell. Such stress relieving also ensures that the preferred core content can remain at least at about 99% pearlite or higher. This gives the bar significant toughness characteristics when used as a grinding rod rather than requiring the stronger but more brittle bainitic core.

Although preferred embodiments of the invention have been described herein in detail, it will be understood by those skilled in the art that variations may be made thereto without departing from the spirit of the invention or the scope of the appended claims.

I claim:

1. A process for making a grinding rod having a hardened outer shell of tempered martensite wherein said rod has been stress relieved to reduce longitudinal internal compressive stresses in the martensitic shell to less than 60 ksi and greater than 15 ksi and thereby stabilize said rod against break up as caused by the balancing longitudinal tensile stresses in the pearlitic core exceeding the tensile strength of the core, said process comprising:

i) reheating a tempered grinding rod having a hardened outer shell of tempered martensite to its previous equalization temperature of its earlier tempering process;

ii) holding the grinding rod at the equalization temperature for a period of time sufficient to relieve compressive stresses in the tempered martensite shell to less than 60 ksi and greater than 15 ksi; and iii) allowing the reheated stress relieved bar to cool.

2. A process of claim 1 for making a rod having a chemistry of:

| | |
|---|---|
| carbon | .70–1.00% by weight |
| manganese | .60–1.00% by weight |
| silicon | .10–.40% by weight |
| chromium | residual levels–1.04% by weight |
| molybdenum | residual levels–0.5% by weight. |

3. A process of claim 1 for making a rod having a chemistry of:

| | |
|---|---|
| carbon | .70–1.00% by weight |
| manganese | .60–1.00% by weight |
| silicon | .10–.40% by weight |
| chromium | .25–1.04% by weight |
| molybdenum | .01–.25% by weight. |

4. A process of claim 3 wherein said equalization temperature is in the range of about 150° C. to 350° C.

5. A process of claim 4 wherein said equalization temperature is about 200° C.

6. A process of claim 5 wherein said compressive stress in said tempered martensitic shell is relieved to be within the range of about 20 ksi to 40 ksi.

7. A process of claim 1 wherein said reheated bar is air cooled after said holding period.

8. A process of claim 2 wherein said bar has soft end portions of a hardness of less than 35 Rockwell C which remain soft during said stress relieve of said bar.

9. A process of claim 8 wherein said bar has a pearlitic core of a hardness of less than 45 Rockwell C.

10. A process of claim 9 wherein said core is at least 99% by weight pearlite.

11. A process of claim 1 wherein said reheating step at equalization temperature for said tempered rod results in minimal hardness reduction in said tempered martensitic shell.

12. A process of claim 1 for making a rod having a chemistry of:

| | |
|---|---|
| carbon | at least 0.7% by weight |
| manganese | less than 0.7% by weight |
| silicon | .10–.40% by weight |
| chromium | at least .25% by weight |
| molybdenum | at least .25% by weight. |

13. A process of claim 1 wherein said tempered grinding rod is made by the process comprising:

i) reheating a formed steel bar to above its austenitising temperature in a controlled manner to produce a reheated bar of substantially uniform reheat temperature;

ii) transferring with minimal cooling said reheated bar to an open tubular quench vessel which is capable of enclosing an entire bar length, closing said vessel to provide a quench liquid tight seal about said bar while securing said bar in said vessel to minimize bar warping in said vessel during quenching,;

iii) introducing quench water into an inlet end of said vessel and passing said quench liquid along said vessel at high surface velocities exceeding 4 meters per second relative to bar surface to minimize thereby production of steam along the bar length and ensure uniform heat removal and removing quench water at an outlet end of said vessel;

iv) quenching said bar in said vessel for a period of time which provides a bar surface equalization temperature when removed from said vessel of less than 350° C. and greater than 150° C. to provide a uniform annular layer for said hard outer shell of tempered martensite and said softer core of pearlite where the end surface hardness is consistent with said hard tempered martensite shell, said developed uniform outer shell of tempered martensite producing uniform residual stress contributing to rod straightness; and v) reheating each end portion of said bar in a furnace to elevate, in a controlled manner, said less than 15 cm end portion including its core to the austenitising temperature, air cooling each said end portion to provide said engineered end portion hardness of less than 35 Rockwell C.

14. A process of claim 13 wherein said high velocity quench water produces a uniform compressive stress in said martensitic shell.

* * * * *